US011437754B2

(12) United States Patent
Egenhofer

(10) Patent No.: US 11,437,754 B2
(45) Date of Patent: Sep. 6, 2022

(54) PLUG CONNECTOR MODULE FOR ELECTRICAL CONTACTS IN THE VEHICLE SECTOR AND METHOD FOR CONNECTING AT LEAST TWO CONTACT ELEMENTS TO A PLUG CONNECTOR MODULE

(71) Applicant: Lisa Draexlmaier GmbH, Vilsbiburg (DE)

(72) Inventor: Ulrich Egenhofer, Landshut (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 16 days.

(21) Appl. No.: 17/235,961

(22) Filed: Apr. 21, 2021

(65) Prior Publication Data

US 2021/0336373 A1 Oct. 28, 2021

(30) Foreign Application Priority Data

Apr. 23, 2020 (DE) ..... 10 2020 111 079.0

(51) Int. Cl.

| | |
|---|---|
| ***H01R 29/00*** | (2006.01) |
| ***H01R 13/518*** | (2006.01) |
| ***H01R 12/72*** | (2011.01) |
| ***H01R 13/514*** | (2006.01) |

(52) U.S. Cl.

CPC ..... *H01R 13/518* (2013.01); *H01R 12/724* (2013.01); *H01R 13/514* (2013.01)

(58) Field of Classification Search

CPC .. H01R 12/722; H01R 12/724; H01R 13/514; H01R 13/516; H01R 13/518

USPC ..... 439/43–45

See application file for complete search history.

(56) References Cited

U.S. PATENT DOCUMENTS

| | | | | |
|---|---|---|---|---|
| 7,097,476 | B2 | 8/2006 | Morikawa et al. | |
| 10,389,060 | B2 * | 8/2019 | Diessel | H01R 13/6275 |
| 2020/0176918 | A1 | 6/2020 | Wolf | |

FOREIGN PATENT DOCUMENTS

| | | |
|---|---|---|
| DE | 102015222561 | 5/2017 |
| JP | 2009043661 | 2/2009 |

* cited by examiner

*Primary Examiner* — Khiem M Nguyen
(74) *Attorney, Agent, or Firm* — Burris Law, PLLC

(57) ABSTRACT

A plug-connector module for electrical contacts in the vehicle sector features the following: at least two contact elements that each feature at least one contact opening for receiving an electrical contact, and each features at least one first engagement device; and at least one positioning element for connecting the contact elements. For this purpose, the positioning element includes at least two second engagement devices that are configured complementary to the first engagement devices. Each contact element features at least one positioning opening for pushing-through the at least one positioning element. Furthermore, the present disclosure relates to a method for connecting at least two contact elements to a plug-connector module.

10 Claims, 2 Drawing Sheets

Figure 1:
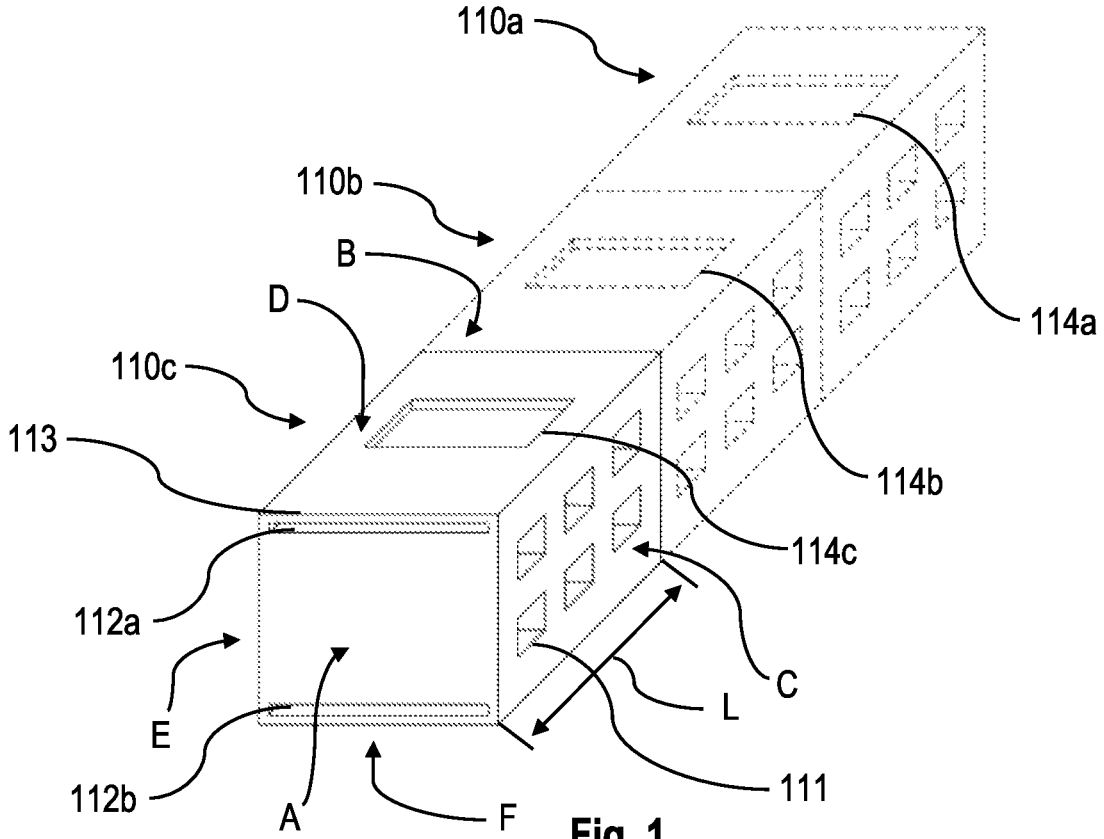

PLUG CONNECTOR MODULE FOR ELECTRICAL CONTACTS IN THE VEHICLE SECTOR AND METHOD FOR CONNECTING AT LEAST TWO CONTACT ELEMENTS TO A PLUG CONNECTOR MODULE

CROSS-REFERENCE TO RELATED APPLICATIONS

This application claims priority to and the benefit of DE 10 2020 111 079.0, filed on Apr. 23, 2020. The disclosure of the above application is incorporated herein by reference.

FIELD

The present disclosure relates to a plug connector module for electrical contacts in the vehicle sector. The present disclosure further relates to a method for connecting at least two contact elements to a plug connector module.

BACKGROUND

The statements in this section merely provide background information related to the present disclosure and may not constitute prior art.

Plug connectors are usually used in the vehicle sector for separating and connecting electrical lines. In this regard the plug connectors have contact openings for the receiving of electrical contacts of the electrical lines. A plurality of plug connectors are typically needed in vehicles, so it is common to use modular plug connectors. In this regard modular plug connectors feature a plurality of contact inserts or contact elements having contact openings for receiving electrical contacts that are usually disposed with respect to one another using retaining frames or housings.

For example, a retaining frame for retaining plug connector modules is known from DE 10 2015 222 561 A1, wherein the plug connector modules are usable in the retainer frame. Here plug-module retaining devices on the plug-connector modules interact with retaining frame devices provided on opposing side parts of the retaining frame.

A disadvantage of such modular concepts including retaining frames or housings is that a suitable recess must be provided for the contact inserts. This means that it must be specified in advance how many contact inserts are to be used in the retaining frames or the housing. An arbitrary positioning of the contact inserts is therefore not possible. This also means that for representing an arbitrary combination of contact inserts, an indefinite number of different housings or retaining frames is required.

Thus it is desirable to implement modular concepts without retaining frames or housings. In this regard the contact inserts are usually directly connected to one another. This means that the contact inserts feature connecting elements that are complementary to one another, such as, for example, grooves and springs, by which the contact inserts can be connected to one another. However, in such a design the mechanical stability is greatly impaired, in particular if a plurality of contact inserts are to be connected. In addition, the individual contact inserts must be manufactured in an expensive manner since they each must include at least two of the complementary connecting elements.

With the known modular plug connectors or plug-connector modules there is thus a problem to the effect that they are not usable in a flexible enough manner and have only a low mechanical stability. Furthermore, they are often too expensive to manufacture.

SUMMARY

This section provides a general summary of the disclosure and is not a comprehensive disclosure of its full scope or all of its features.

The present disclosure provides a plug-connector module, in particular for electrical contacts in the vehicle sector, that can be used in a flexible manner is characterized by high mechanical stability, and is simultaneously economical to manufacture.

The present disclosure includes a plug-connector module for electrical contacts in the vehicle sector, wherein the plug-connector module features the following: at least two contact elements that each feature at least one contact opening for receiving an electrical contact, and each feature at least one first engagement device; and at least one positioning element for connecting the contact elements, wherein for this purpose the positioning element features at least two second engagement devices that are configured complementary to the first engagement devices, wherein each contact element features at least one positioning opening for pushing-through the at least one positioning element.

Each contact element in one form features a plurality of contact openings for receiving electrical contacts. The electrical contacts are attached, for example, to a plug that can be plugged into the contact element.

The positioning element in one form features a variety of second engagement devices. Furthermore, the plug-connector module features a variety of contact elements.

The first and second engagement devices can be configured, for example, as latching devices. Here the second engagement devices can be configured as latching lugs, and the first engagement devices can be configured as latching openings, or vice versa.

When connecting the contact elements, the positioning element is pushed in the insertion direction by the contact elements. For this purpose each contact element features the at least one positioning opening, through which the positioning element can be pushed. Adjacent contact elements are furthermore disposed adjacent to one another such that the positioning openings are aligned flush with one another.

The positioning opening extends from a first side of the contact element to a second side of the contact element, wherein openings are created on the first side of the contact element and on the second side of the contact element. When viewed in the insertion direction, the cross-section of the positioning opening can remain constant through the contact element. It would also be conceivable that the cross-section of the positioning opening in a central region of the contact element differs from the cross-section at the openings. This can be the case, for example, if the contact element between the two openings is configured as hollow.

When pushing the positioning elements through the contact openings of the contact elements, the second engagement device engages with the complementarily configured first engagement devices such that the position of the contact elements with respect to the positioning element can be fixed. Thus the position of the contact elements with respect to one another can also be fixed.

The advantage of the present plug-connector module is that the contact elements can be easily fixed with respect to one another without having to use, for example, expensive frames or housings. In addition, with the use of frames and housings, the number and size of the contact elements to be used must be known in advance. The plug-connector modules thus cannot be used in a flexible manner. In contrast thereto, the inventive plug-connector module is not limited to a certain size. Rather, it is possible to arrange the required number of contact elements one-behind-the-other and to connect them using the positioning element. The only requirement is that the positioning element is long enough to connect the desired number of contact elements.

If the positioning element is too long, the protruding region can be simply cut off. The positioning element can be, for example, a by-the-meter product that is cuttable to the required length and is correspondingly economical. Particularly, the positioning element can be manufactured from metal plate. Furthermore, the manufacturing costs of the plug-connector module are also low since the contact elements can be designed as relatively simple. These only require first engagement devices and at least one positioning opening. In comparison thereto, the contact elements known from the prior art that can be connected to one another are designed as significantly more complex, and therefore are more expensive to manufacture. In addition, the positioning element results in a high mechanical stability of the plug-connector module. This is due in particular to the fact that the positioning element is configured as a continuous element.

In particular, the plug-connector module can be used in a flexible manner, has a high stability and is also economical to manufacture.

According to one advantageous refinement of the present disclosure, the at least one positioning element features a variety of second engagement devices that are disposed at regular spacings to one another.

That the second engagement devices are disposed at regular spacings to one another means that the spacing between two adjacent second engagement devices is always the same size.

One advantageous embodiment provides that the spacing between two adjacent second engagement devices corresponds to a unit length, wherein each contact element features an extension length in the insertion direction of the positioning element that corresponds to the unit length or an integer multiple of the unit length.

The simple unit length thus also corresponds to the minimum length of a contact element in the insertion direction of the positioning element. Since the spacing between two adjacent second engagement devices on the positioning element always corresponds exactly to the unit length, it is possible to use contact elements of different sizes, i.e., having different extension lengths. The only restriction here is that the extension length of each contact element must always be an integer multiple of the unit length.

Overall, the introducing of the unit length thus makes it possible to use differently sized contact elements, so that the use of the plug-connector module is even more flexible.

A particularly advantageous design of the present disclosure provides that the positioning opening is configured as slot-shaped and the at least one positioning element is configured at least substantially as plate-shaped.

Due to the slot-shaped design of the positioning opening and the correspondingly at least substantially plate-shaped design of the positioning element, a particularly high mechanical stability is achieved. In particular, a particularly large contact region is achieved between contact element and positioning element. With positioning openings configured as slot-shaped, elongated openings are created on the first side and the second side of the contact element. Here the openings are particularly preferably formed substantially from a first edge of the first or second side to an opposing second edge of the first side or second side. Furthermore, the elongated openings are particularly configured as parallel to a third edge that connects the first edge to the second edge.

According to one advantageous form, the contact elements are configured at least substantially as square-shaped and include four outer surfaces and two side surfaces, wherein openings of the positioning opening are formed on the side surfaces, wherein the at least one contact opening is formed on a first outer surface, and wherein the at least one first engagement device is formed on a second outer surface.

The two side surfaces of the square are the two surfaces of the side that have been referred to up to now as the first and second sides. Particularly the second outer surface, on which the at least one first engagement device is formed, is disposed adjacent to the first outer surface on which the at least one contact opening is formed.

Overall, a simple and compact design of the contact elements results, so that they are economical to manufacture. Square-shaped contact elements are also particularly well suited to be positioned against one another. Alternatively thereto it would also be conceivable that the shortest contact element, i.e., the contact element having an extension length that corresponds to the unit length, is configured as a cube. Then only the larger contact elements would be configured as square-shaped.

According to one advantageous refinement of this form, the opening of the positioning opening is respectively disposed near an edge to the second outer surface and extends parallel to the corresponding edge.

Here the edge corresponds to the edge previously referred to as a third edge. A particularly high stability is thereby achieved. The positioning element can thus be guided very closely against the surface having the second latching devices. In addition, a positioning element disposed on the edge of the contact element does not claim any functional installation space that is used for the receiving of the electrical contact.

In one form, the plug-connector module includes two positioning elements, and each contact element includes a positioning opening for each positioning element.

With two positioning elements, the stability of the plug-connector module is further increased. The positioning elements can be configured as identical to one another, so that identical parts can be used here. As already mentioned, in particular the use of a by-the-meter product is possible. The two positioning elements extend parallel to each other through the contact elements. The two positioning openings are particularly disposed near two opposing edges of the side surfaces of the contact element.

A more expedient design provides that the two positioning elements are already connected to each other prior to the inserting into the contact elements.

The positioning elements thus form a unit. In particular, the positioning elements are configured as a clasp device. The positioning elements can then both be inserted into the contact elements simultaneously in one installation step. The two positioning elements extend parallel to each other. Accordingly the contact elements include first engagement devices on two opposing sides or surfaces. Overall, a high stability and a simple installation are thereby combined.

According to one advantageous form of the present disclosure, at least one positioning element extends out of the first and/or the last contact element and includes a fixing device for fixing a plug.

The front or rear contact element of the mutually positioned contact elements of the plug-connector module is referred to as the first or last contact element, respectively. The fixing device for fixing the plug is disposed at the region that extends out of the corresponding contact element. The plug is generally the carrier of the electrical contacts that are to be received in the contact openings. The positioning element thus fulfills an additional second function, and specifically a secure holding of the electrical contacts. The fixing device may simply be a bore, for example. Alternatively thereto it can also be, for example, a latching device.

The region that extends out of the corresponding contact element can particularly be a connecting region that connects a first positioning element to a second positioning element. Thus the advantages that arise from the design of the positioning elements as a clasp device and the design with a fixing device can be combined.

The inventive solution further includes specifying a method for connecting at least two contact elements to a plug-connector module, wherein the method includes the following steps: providing the at least two contact elements that each feature at least one contact opening for receiving an electrical contact, and furthermore at least one first positioning opening; arranging of the at least two contact elements adjacent to one another such that the positioning openings are aligned flush to one another; and inserting of at least one positioning element through the positioning openings of the contact elements so that the contact elements are connected to one another using the positioning element, wherein the contact elements feature at least two first engagement devices, and the positioning element features at least two complementarily configured second engagement devices that come into engagement with the first engagement devices.

All aspects that have already been discussed with respect to the plug-connector module apply here as well. In particular, the plug-connector module that is obtained using the method for connecting at least two contact elements to a plug-connector module can be one of the above-described plug-connector modules. Accordingly all of the above-described aspects and advantages also apply for the method. The advantages resulting therefrom have already been discussed with respect to the device and are therefore not repeated at this point.

The present disclosure is explained in greater detail below based on the description of exemplary forms with reference to the accompanying drawings. Here further advantageous forms and feature combinations of the present disclosure arise from the following description and the entirety of the patent claims.

Further areas of applicability will become apparent from the description provided herein. It should be understood that the description and specific examples are intended for purposes of illustration only and are not intended to limit the scope of the present disclosure.

DRAWINGS

Figure 2:
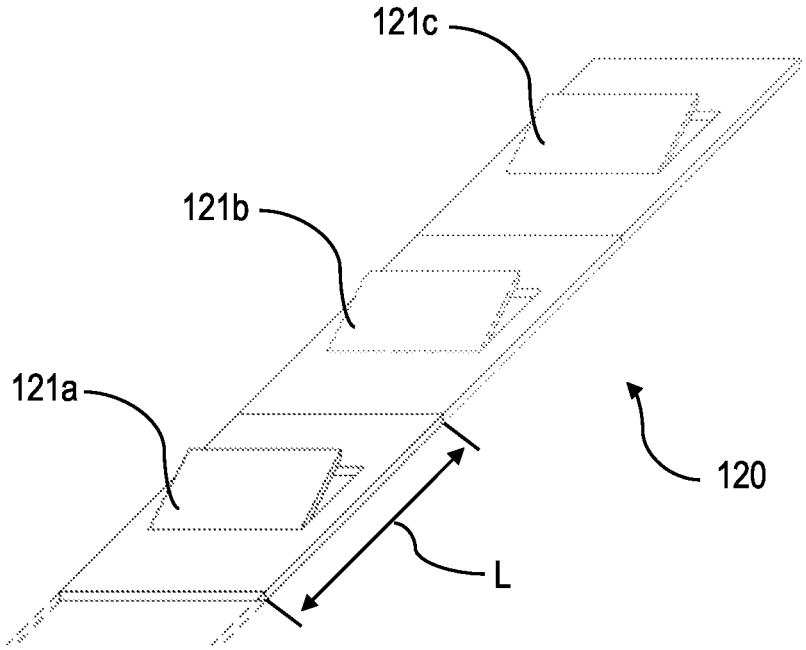
Figure 3:
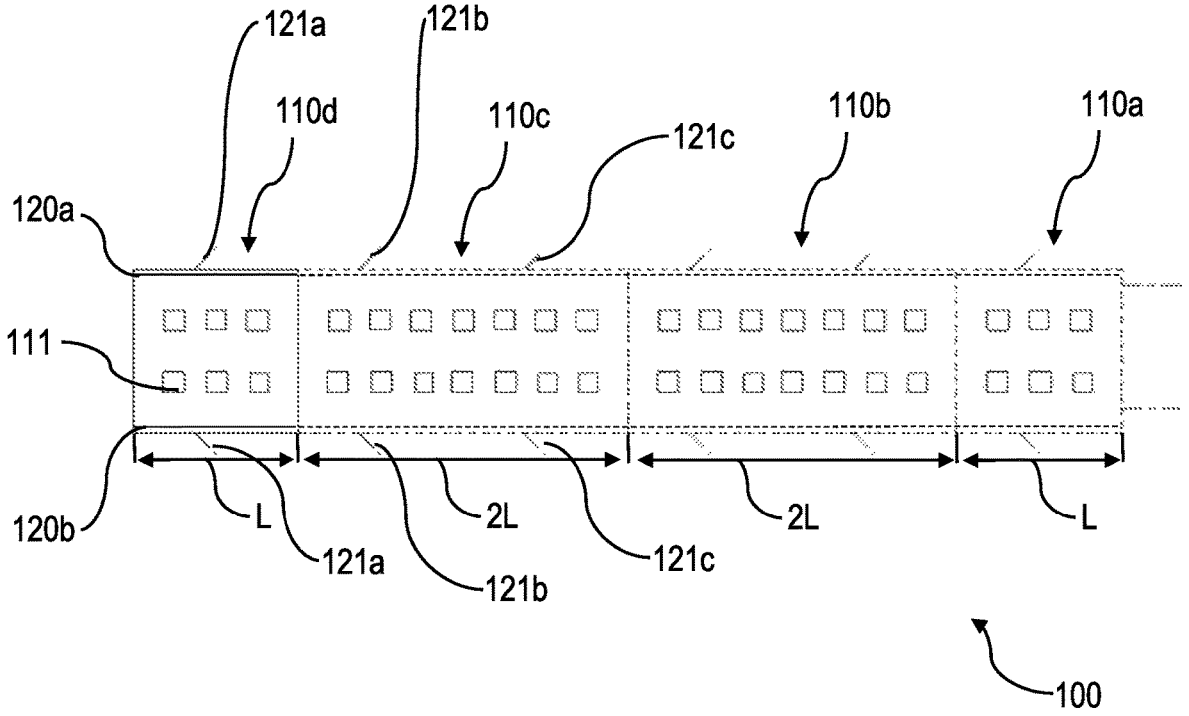
Figure 4:
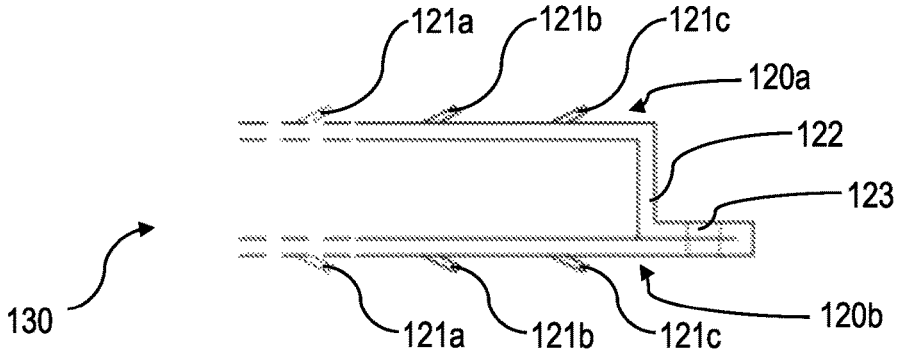

In order that the disclosure may be well understood, there will now be described various forms thereof, given by way of example, reference being made to the accompanying drawings, in which:

FIG. 1 provides a schematic depiction of the positioning of a plurality of contact elements in accordance with the teachings of the present disclosure;

FIG. 2 provides a schematic depiction of a positioning element in accordance with the teachings of the present disclosure;

FIG. 3 provides a plan view of a plug-connector module in accordance with the teachings of the present disclosure; and FIG. 4 provides a schematic depiction of a clasp device formed from two positioning elements in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

All specifications of directions in the description are understood from the viewpoint of an observer who is in front of the plug-connector module looking toward the contact openings, i.e., as in plan view in FIG. 3.

FIG. 1 provides a schematic depiction of a positioning of a plurality of contact elements 110*a*, 110*b*, 110*c*. The contact elements 110*a*, 110*b*, 110*c* are configured at least substantially as square-shaped and include four outer surfaces C, D, E, F, and two smaller side surfaces A, B.

A first contact element 110*c* is depicted with continuous lines, and a second contact element 110*b* and a third contact element 110*a* are depicted as dashed lines. For the sake of simplicity the contact elements 110*a*, 110*b*, 110*c* are configured as identically sized. This means that the length of the contact elements 110*a*, 110*b*, 110*c* corresponds in the main extension direction to a unit length L.

On a front side, the outer surface C, the contact element 110*c* includes six contact openings 111, wherein only one of the contact openings is provided with the reference number 111. The other contact elements 110*b* and 110*a* also include contact openings 111 on the corresponding side. The contact openings 111 serve to receive an electrical contact, for example, from a plug.

The contact elements 110*a*, 110*b*, and 110*c* are positioned one-behind-the-other, wherein they can be connected to one another using the positioning element 120 depicted in FIG. 2. For this purpose the contact element 110*c* includes two positioning openings 112*a* and 112*b* on the side surface A. The positioning openings 112*a* and 112*b* extend through the entire contact element 110*b* from the side surface A up to the side surface B.

The openings of the positioning openings 112*a* and 112*b* are visible on the side surface as clearly depicted in FIG. 1. Since the contact elements 110*b* and 110*a*, even if this is not visible in FIG. 1, feature corresponding positioning openings that are aligned flush with the positioning opening 112*a* or 112*b*, it is possible to push the positioning element 120 through the positioning openings 112*a*, 112*b* into the contact elements 110*a*, 110*b*, and 110*c* and to connect the contact elements 110*a*, 110*b*, 110*c*.

The positioning openings 112*a* and 112*b* are configured at least substantially as slot-shaped. Here the openings are configured as elongated and extend parallel to an edge 113 that connects the side surface A to the outer surface D. The same applies to the edge that connects the side surface A to the outer surface F, which, however, is not provided with a reference number.

The contact element 110*a* features a first engagement device 114*c* on the outer surface D. Accordingly the contact elements 110*b* and 110*a* also feature first engagement devices 114*b* and 114*a*. In the embodiment depicted in FIG. 1, the first engagement devices 114*a*, 114*b*, and 114*c* are latching openings. Alternatively, it would of course also be conceivable that the first engagement devices 114*a*, 114*b*, and 114*c* are configured as latching lugs.

The positioning element 120 depicted in FIG. 2 includes a plurality of second engagement devices 121*a*, 121*b*, and 121*c*. Here the second engagement devices 121*a*, 121*b*, and 121*c* depicted are latching lugs by way of example. It would of course also be conceivable here that the second engagement devices 121*a*, 121*b*, and 121*c* are instead configured as latching openings. In this context it is only important that the second engagement devices 121*a*, 121*b*, and 121*c* are configured complementary to the first engagement devices 114*a*, 114*b*, and 114*c*.

The positioning element 120 is configured at least substantially as plate-shaped. The second engagement devices 121*a*, 121*b*, and 121*c* are spaced from one another at a constant spacing. As can be seen in FIG. 2, this spacing corresponds to the unit length L.

When viewing FIG. 1 and FIG. 2 together it is evident that the positioning element 120 of FIG. 2 can be pushed into the positioning opening 112*a* or the positioning opening 112*b*.

Here the second engagement devices 121*a*, 121*b*, and 121*c* come into engagement successively with the first engagement devices 114*a*, 114*b*, and 114*c*. Here the engagement devices are configured with respect to one another such that the positioning element 120 can be pushed farther in the insertion direction through the contact elements 110*a*, 110*b*, and 110*c*. For the three depicted contact elements 110*a*, 110*b*, and 110*c*, this means that when inserting the positioning element 120 into the positioning opening of the contact element 110*a*, the second engagement device 121*a* first comes into contact with the first engagement device 114*a*. With further inserting of the positioning element 120*a*, the contact of the second engagement device 121*a* releases from the first engagement device 114*a*, and the second engagement device 121*a* comes into contact with the first engagement device 114*b*, and the second engagement device 121*b* comes into contact with the first engagement device 114*a*. Accordingly with further inserting of the positioning element 120 these contacts release, wherein then the second engagement device 121*a* comes into contact with the first engagement device 114*c*, the second engagement device 121*b* comes into contact with the first engagement device 114*b*, and the second engagement device 121*c* comes into contact with the first engagement device 114*a*.

The same also applies for the positioning opening 112*b*, wherein then the second engagement devices 121*a*, 121*b*, and 121*c* are aligned toward the outer surface F of the contact elements 110*a*, 110*b*, and 110*c*. The first engagement devices disposed on the outer surface F are not depicted in FIG. 1.

Of course, in both cases it is also possible first to push the positioning element 120 into the positioning openings 112*a*, 112*b* of the contact element 110*a* and from there farther into the other contact elements 110*b*, 110*c*. The contact elements 110*a*, 110*b*, and 110*c* are thus connectable from left and/or right.

An exemplary plug-connector module 100 is depicted in FIG. 3. More specifically, FIG. 3 shows a plan view of the plug-connector module 100. Although the contact element 110*b* and the contact element 110*c* in FIG. 3 are configured longer than in FIG. 1, the reference numbers have been retained in order to keep the description as simple as possible. One of the significant advantages of the present disclosure is visible here. Thus, contact elements 110*a*, 110*b*, 110*c*, and 110*d* having different lengths can be connected to one another. Here the lengths of the contact elements 110*a*, 110*b*, 110*c*, and 110*d* correspond to the unit length L or an integer multiple of the unit length L. With the contact elements 110*a*, 110*b*, 110*c*, and 110*d* depicted in FIG. 3, the contact elements 110*a* and 110*d* are formed as long as the unit length L. In contrast, the contact elements 110*b* and 110*c* are formed twice as long as the unit length L.

Since the second engagement devices 121*a*, 121*b*, and 121*c* are respectively disposed with a spacing that corresponds to the unit length L on the positioning elements 120*a* and 120*b*, a second engagement device 121*a* comes into engagement with the contact element 110*d*, and two second engagement devices 121*b* and 121*c* come into engagement with the contact element 110*c*. Accordingly the contact element 110*c* also includes two first engagement devices that for the sake of clarity are not depicted in FIG. 3.

FIG. 4 shows a schematic depiction of clasp device 130. The clasp device 130 is formed from two positioning elements 120*a* and 120*b*. Here the two positioning elements 120*a* and 120*b* are connected via a connecting region 122. The connecting region 122 spaces the positioning elements 120*a* and 120*b* from each other such that they can be pushed into the associated positioning openings 112*a* and 112*b*. The second engagement devices 121*a*, 121*b*, and 121*c* configured as latching lugs point outward so that they can come into contact with the complementary first engagement devices 114*a*, 114*b*, and 114*c*. The positioning elements 120*a* and 120*b* are in particular aligned and disposed parallel to each other. The advantage of the clasp device 130 shown in FIG. 4 is evident. Since the positioning elements 120*a* and 120*b* are connected to each other, they can be pushed together, i.e., in a single installation step, into the positioning openings 112*a* and 112*b*. The installation is thereby simplified.

A fixing device 123 is disposed at the connecting region 122. The fixing device 123 can be used, for example, for fixing a plug that carries the electrical contacts that are inserted into the contact openings 111. The clasp device 130 thus performs an additional second function, and specifically a secure holding of the electrical contacts. Merely by way of example, the fixing device 123 can be, as depicted, a bore.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A plug-connector module for electrical contacts, wherein the plug-connector module comprises:

at least two contact elements, each contact element comprising at least one contact opening for receiving an electrical contact and at least one first engagement device; and at least one positioning element for connecting the at least two contact elements, wherein the at least one positioning element comprises at least two second engagement devices configured complementary to the first engagement devices, wherein each contact element comprises at least one positioning opening for pushing-through the at least one positioning element.

2. The plug-connector module according to claim 1, wherein the at least one positioning element comprises a variety of second engagement devices disposed at regular spacings to one another.

3. The plug-connector module according to claim 2, wherein a spacing between two adjacent second engagement devices corresponds to a unit length and wherein each contact element has an extension length in an insertion direction of the at least one positioning element that corresponds to the unit length or an integer multiple of the unit length.

4. The plug-connector module according to claim 1, wherein the at least one positioning opening is configured as slot-shaped and the at least one positioning element is configured at least substantially as plate-shaped.

5. The plug-connector module according to claim 1, wherein the at least two contact elements are configured at least substantially as square-shaped and comprise four outer surfaces and two side surfaces, and wherein openings of the at least one positioning opening are formed on the side surfaces wherein the at least one contact opening is formed on a first outer surface, and wherein the at least one first engagement device is formed on a second outer surface.

6. The plug-connector module according to claim 5, wherein the opening of the at least one positioning opening is respectively disposed near an edge of the second outer surface and extends parallel to a corresponding edge.

7. The plug-connector module according to claim 1, wherein the plug-connector module comprises two positioning elements and each contact element comprises a positioning opening for each positioning element.

8. The plug-connector module according to claim 7, wherein the two positioning elements are connected to each other prior to being inserted into the contact elements.

9. The plug-connector module according to claim 1, wherein the at least one positioning element extends out of at least one of a first and a last contact element and features a fixing device for fixing a plug.

10. A method for connecting at least two contact elements to a plug-connector module, wherein the method comprises:

providing the at least two contact elements such that each contact element comprises at least one contact opening for receiving an electrical contact and at least one positioning opening;

arranging the at least two contact elements adjacent to one another such that the at least one positioning opening for each of the least two contact elements are aligned flush to one another; and inserting at least one positioning element through the at least one positioning openings of the at least two contact elements so that the at least two contact elements are connected to one another using the at least one positioning element, wherein the at least two contact elements comprise at least two first engagement devices and the at least one positioning element comprises at least two complementarily formed second engagement devices that come into engagement with the at least two first engagement devices.

* * * * *